United States Patent [19]

Ho

[11] Patent Number: 4,785,521

[45] Date of Patent: Nov. 22, 1988

[54] METHOD FOR AUTOMATICALLY LINKING BEADS OR THE LIKE

[76] Inventor: Sheng-Wu Ho, No. 73, Hotsuoh St., Seatwen, Taichung City, Taiwan

[21] Appl. No.: 28,766

[22] Filed: Mar. 23, 1987

[51] Int. Cl.[4] ..... B23P 19/04

[52] U.S. Cl. ..... 29/433; 29/241

[58] Field of Search ..... 29/241, 433; 223/48; 414/27

[56] References Cited

U.S. PATENT DOCUMENTS

| | | | |
|---|---|---|---|
| 2,327,957 | 8/1943 | Brandt | 223/48 |
| 2,640,631 | 6/1953 | Littvlo et al. | 223/48 |
| 3,907,180 | 9/1975 | Birk et al. | 29/241 X |
| 4,264,254 | 4/1981 | Cheng | 29/241 X |
| 4,280,266 | 7/1981 | Tomita et al. | 29/241 |

FOREIGN PATENT DOCUMENTS

| | | | |
|---|---|---|---|
| 1435243 | 1/1969 | Fed. Rep. of Germany | 29/241 |

*Primary Examiner*—Timothy V. Eley

*Attorney, Agent, or Firm*—Cushman, Darby & Cushman

[57] ABSTRACT

A method is provided for automatically linking beads or the like, in each of which have a through hole. In this method, a thread having a predetermined length is fastened at one end thereof onto a straight elongated magnetic member and at the other end onto a stationary fixture. A magnetic block is positioned near the elongated magnetic member so that the elongated magnetic member is attracted by the magnetic block in an upward direction, therefore leaving a working space of a desired size between the magnetic block and the elongate magnetic member. The beads or the like ar fed by a feeder into the working space one by one while permitting their through holes to be brought into registry with the free end of the elongated magnetic member. At the time of the registry, the beads or the like will automatically sleeve on the elongated magnetic member and in turn slide downwardly along the thread due to the fact that the elongated magnetic member is attracted in the upward direction.

3 Claims, 3 Drawing Sheets

METHOD FOR AUTOMATICALLY LINKING BEADS OR THE LIKE

The present invention relates to a method for linking beads or the like, and more particularly to a method for linking beads having through holes through which a thread is threaded.

In manufacturing a train of beads, beads are generally linked together by engagement of a thread with the through hole of each of the beads. Conventionally, engagement of the thread and the through holes of the beads is achieved by hand, each bead being threaded one by one. This wastes much time and therefore increases the cost of the linking process.

SUMMARY OF THE INVENTION

It is therefore an object of the present invention to provide a highly efficient method for automatically linking beads or the like.

According to the present invention, the method for automatically linking beads or the like includes the following steps: (1) fastening a first portion of a thread onto a straight elongated magnetic member; (2) fastening a second portion of the thread onto a stationary fixture, the first and second portions of the thread being spaced from each other at a predetermined distance; (3) fixing a magnetic block at a position spaced from the fixture at a distance slightly larger than the predetermined distance so that the magnetic member is attracted by the magnetic block in an upward direction while permitting a working space to be left between the magnetic member and the magnetic block; and (4) moving a plurality of beads each having a through hole or the like into the working space one by one while permitting the through holes of the beads or the like to be brought into registry with the magnetic member, therefore permitting the beads or the like to sleeve on the free end of the magnetic member and in turn to slide downwardly along the thread one by one due to the fact that the magnetic member is attracted in the upward direction.

DETAILED DESCRIPTION OF THE PREFERRED EMBODIMENTS

Figure 1:
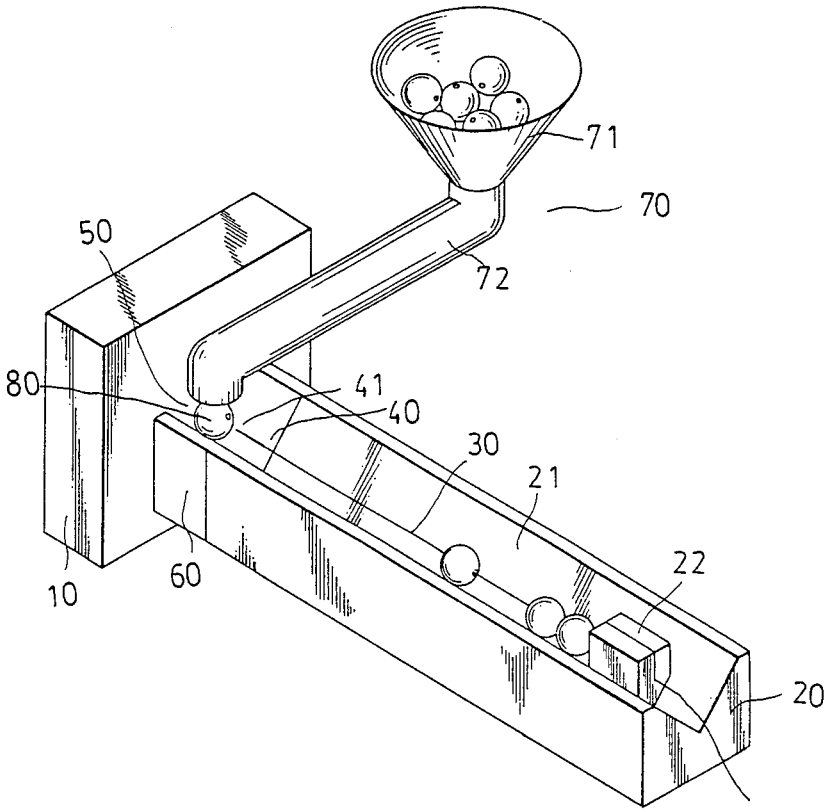
FIG. 1 is a perspective view illustrating a method for automatically linking beads according to the present invention.
Figure 2:
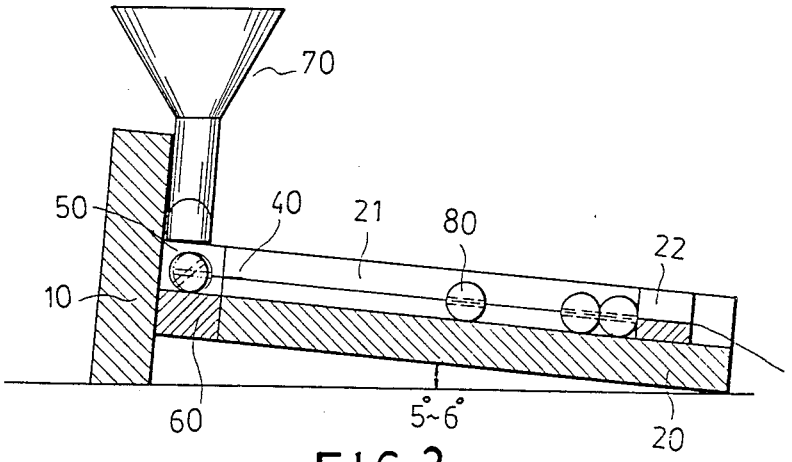
FIG. 2 is a sectional view illustrating the method for automatically linking the beads according to the present invention.

According to the present invention, a linking device is provided. Referring to FIG. 1 with reference to FIG. 2, in an embodiment, a linking device includes a rectangular stationary magnet 10, a guide member 20 connected to the magnet 10 by means of a vibrator 60 which is perpendicular to the magnet 10, a thread 30 gripped on the guide member 20 at an end thereof, a needle 40 fastened onto the opposite end of the thread 30 from the gripped end, and a feeder 70 consisting of a feed hopper 71 and a Z-shaped tube 72 for feeding beads 80 onto the vibrator 60.

The guide member 20 includes a guide groove 21 of a V-shaped cross-section and a plastic fixture 22 with a slit in which the thread 30 is gripped just above the valley of the guide groove 21. Since the needle 40 is made of a metal having magnetic permeability, it is attracted by the magnet 10 so that the thread 30 is straightened. The free end of the needle 40 thus extends beyond the guide member 20. This makes the needle 40 and the thread 30 parallel to and just above the valley of the guide groove 21. As illustrated, it is noted that the guide member 20 is inclined at a degree of 5°–6° so that the needle 40 is attracted in a somewhat upward direction.

The vibrator 60 is of a cross-section the same as that of the guide member 20 so that a V-shaped working space 50 is formed on the upper surface of the vibrator 60. The height of the lower surface of the Z-shaped tube 72 is slightly larger than the diameter of the beads 80. Thus, the working space 50 can receive only one of the beads 80 at a time.

In operation, when one of the beads 80 drops from the Z-shaped tube 72 onto the inclined upper surface of the vibrator 60, the bead 80 will slide downwardly to contact the free end of the needle 40. Then, the bead 80 will be rotated by the vibrator 60 until the through hole of the bead 80 is brought into registry with the needle 40. Since the bead 80 rotated on the vibrator 60 always contacts the free end of the needle 40, when the through hole of the bead 80 registers with the needle 40, the bead 80 will sleeve on the needle 40 and therefore slide downwardly along the needle 40 and the thread 30. Subsequently, in this way, the remainder of the beads 80 will automatically sleeve on the thread 30 through the feed hopper 71, the Z-shaped tube 72, the working space 50, and the needle 40 one by one. It has been proven that 1 to 2 beads can be threaded per second using this automatic linking process. Accordingly, this automatic linking process has practical features for achieving high efficiency.

Figure 3:
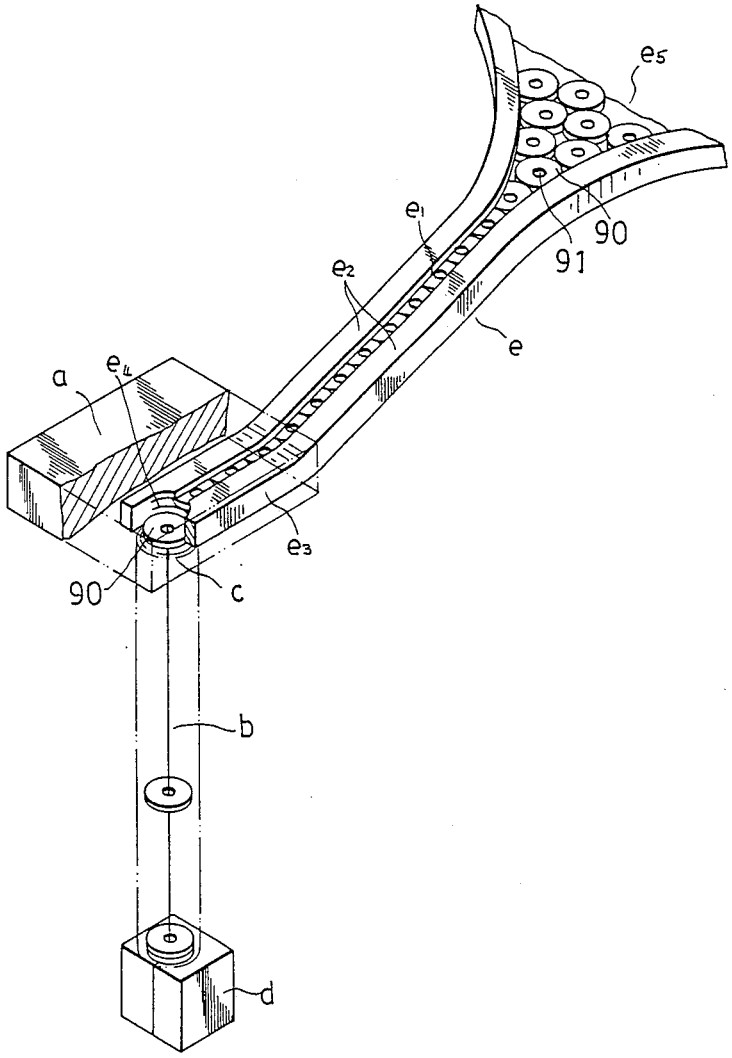
FIG. 3 is a perspective view illustrating a method for automatically linking rings according to the present invention.
Figure 4:
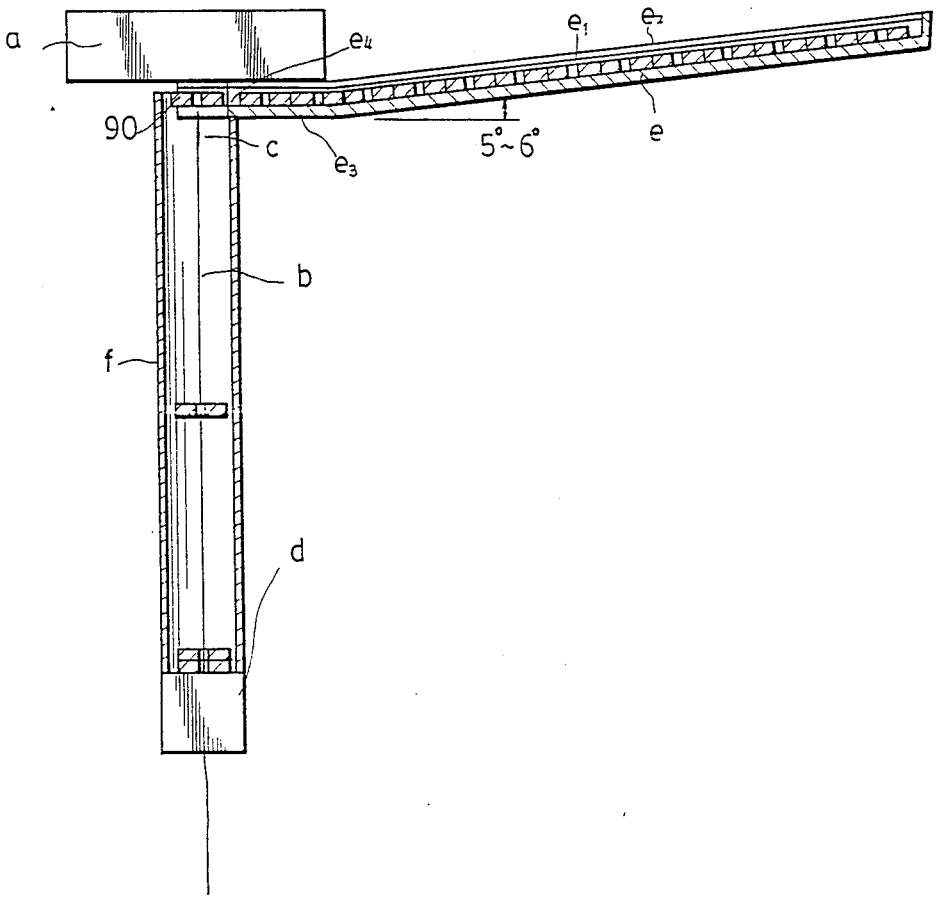
FIG. 4 is a sectional view illustrating the method for automatically linking the rings according to the present invention.

Referring to FIG. 3 with reference to FIG. 4, there is shown another embodiment of the present invention. In this embodiment, a device for automatically linking rings includes a rectangular magnet a, an upright thread b, an upright needle c, a rectangular fixture d for fastening the thread b thereon, and a feeder e interdisposed between the magnet a and an upright tubular guide member f for feeding rings 90 each of which has circular bore 91. The feeder e includes a generally T-shaped guide groove e1, a pair of side walls e2 inclined at a degree of 5°–6°, a horizontal lower portion e3 having a semicircular notch and a curved outlet e4, and an enlarged inlet e5. The diameter of the semicircular notch is slightly larger than that of the rings 90. The free end of the needle c is positioned at a level slightly lower than that of the outlet e4 so that when the rings 90 completely extend out of the outlet e4, the circular bores 91 of the rings 90 will be brought into registry with the needle c, therefore automatically sleeving on the needle c and sliding downwardly one by one due to the pull of gravity.

With the present invention thus explained, it is apparent that various modifications and variations can be made without departing from the scope and spirit of the present invention. It is therefore intended that the present invention be limited as indicated in the appended claims.

What is claimed is:

1. A method of automatically linking a plurality of beads, each said bead having a through-hole, said method comprising the steps of:

dropping said beads, one at a time, onto a guide member, said guide member having a guide surface along a length thereof and a V-shaped cross-section;

pulling a needle, having a thread thereon, so that said needle and thread extend along and are parallel to the length of the guide surface; and agitating said beads, one at a time, so that said through-hole in each of said beads is aligned with the needle so that said beads are threaded onto said needle and thread and slide along the guide surface.

2. An apparatus for automatically linking a plurality of beads, each said bead having a through-hole, said apparatus comprising:

a guide member, said guide member having a guide surface along a length thereof and a V-shaped cross-section;

means for delivering said beads, one at a time, to said guide surface;

a needle having a thread attached thereon;

means for extending the needle and thread along the length of the guide surface; and means for agitating said beads in the guide surface so that said needle is inserted into the through-holes of the beads.

3. An apparatus as in claim 2 wherein said guide surface has an inclination angle of 5° to 6° relative to a horizontal plane.

* * * * *